United States Patent [19]

Le Bel

[11] 4,044,579

[45] Aug. 30, 1977

[54] PROTECTION MEANS FOR MANUALLY OPERATED DEAD BOLT LOCK

[76] Inventor: John Paul Le Bel, 238 1/2 S. Vendome St., Los Angeles, Calif. 90057

[21] Appl. No.: 630,072

[22] Filed: Nov. 21, 1975

[51] Int. Cl.[2] ..... E05B 13/00

[52] U.S. Cl. ..... 70/416; 70/427; 70/461

[58] Field of Search ..... 70/416, 423, 427, 431, 70/447, 461, 312/205

[56] References Cited

U.S. PATENT DOCUMENTS

| | | | |
|---|---|---|---|
| 504,292 | 8/1893 | Badoni | 70/461 X |
| 3,071,425 | 1/1963 | West | 312/205 |
| 3,550,412 | 12/1970 | Pitel | 70/461 |
| 3,888,096 | 6/1975 | Huss | 70/209 |

FOREIGN PATENT DOCUMENTS

| | | | |
|---|---|---|---|
| 143,700 | 10/1951 | Australia | 70/416 |
| 122,751 | 9/1948 | Sweden | 70/423 |
| 619,653 | 3/1949 | United Kingdom | 70/416 |

*Primary Examiner*—Robert L. Wolfe
*Attorney, Agent, or Firm*—J. B. McGuire

[57] ABSTRACT

An enclosure, for housing a manually operated lock, comprising a wall which may be mounted on either the lock or a door to surround the lock and, if necessary, its striker plate. A cover is pivotally mounted on the wall and provided with a key-actuated lock to prevent unauthorized operation of the manually operated lock.

2 Claims, 4 Drawing Figures

PROTECTION MEANS FOR MANUALLY OPERATED DEAD BOLT LOCK

BACKGROUND OF THE INVENTION

Many homes today are provided with manually operated locks on the outer doors to prevent unauthorized ingress. Some of these locks are dead-bolt locks, i.e., locks which are automatically actuated when the door is closed. Other such locks comprise bolts which are manually thrown into a striker plate or receiver opening when it is desired to positively lock the door.

At the same time, many exterior doors in such homes have been built with translucent or transparent panels which are easily broken by persons seeking unauthorized entry into the home or other such building. Thus, when such a person desires to enter the building, it is a very simple matter to break the glass or plastic panel in the door and then reach through the broken panel and manually release the dead bolt or other manually operated device.

In order to solve this problem, some of the lock makers have provided such locks which can be actuated from inside, and sometimes from the outside, only by means of a key. Unfortunately, these devices are relatively expensive to procure and have installed, and also create problems when the old lock must be removed. When the new lock is installed, it is very likely that the door will need to be redrilled and/or repainted since the new lock will probably not be precisely the same size as the old lock. Further, a new striker or receiver must be located on the jamb, creating similar problems since such devices are not always interchangable.

Accordingly, it is desirable to provide a security device which can be utilized with presently available, manually actuatable locks which are inexpensive and which do not require the lock to be replaced.

SUMMARY OF THE INVENTION

The present invention relates to such a security device which may be quickly and easily installed and which prevents an intruder from opening the lock. In its preferred form, the device may comprise a fairly inexpensive, sheet metal enclosure housing which may be attached directly to the door and the lock by the same fastening means which is used to fasten the lock to the door.

Such a housing may, when necessary, extend beyond the edge of the door to cooperate with the door jamb trim in order to prevent an intruder from opening the lock, for example by pushing the dead-bolt latch backward against its spring force.

It will be realized that, in most instances, the plane of the door is not necessarily co-extensive with the plane of the trim on the door jamb. Stated another way, the planar surface of the door and the trim is irregular, thus requiring structure which is adjustable to compensate for such irregularities. In the present invention, this may be accomplished by providing that the depth of the wall of a portion of the housing, preferably that portion which cooperates with the trim, be adjustable; this will allow the device to be employed with any door.

Preferably, the housing can only be opened by a key, after which a lockable cover can be pivoted away from a planar relationship with the outer edge of the housing. Consequently, it will be impossible for an intruder to break the door panel, reach in, and manually deactivate the lock, since the housing and its cover will effectively prohibit such an action.

Those skilled in the art, upon perusal of the following detailed description and the accompanying drawing, will quickly realize that the present invention may be employed with a wide variety of structures, both for the purpose illustrated, and for similar purposes. For example, such a device could be installed over a door knob to prevent the knob from being unlocked and/or turned by an intruder. In any event, such structures will employ the present invention even though differing in appearance and configuration, and may be tested against the invention by reference to the attached claims.

DETAILED DESCRIPTION

Figure 1:
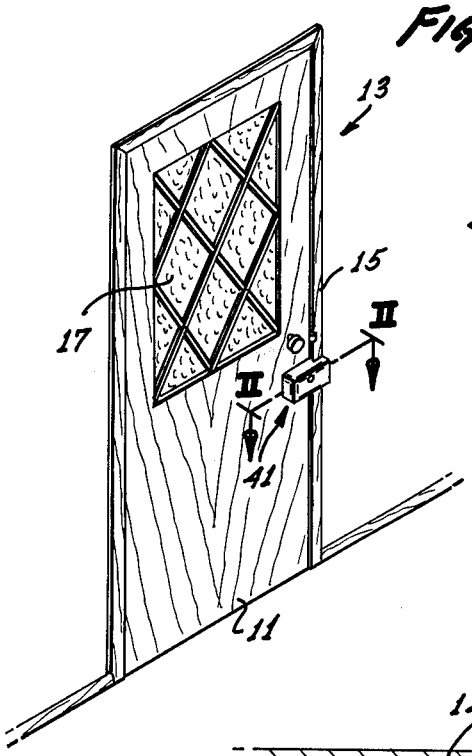
FIG. 1 comprises an isometric illustration of a door upon which the present invention is being employed.
Figure 2:
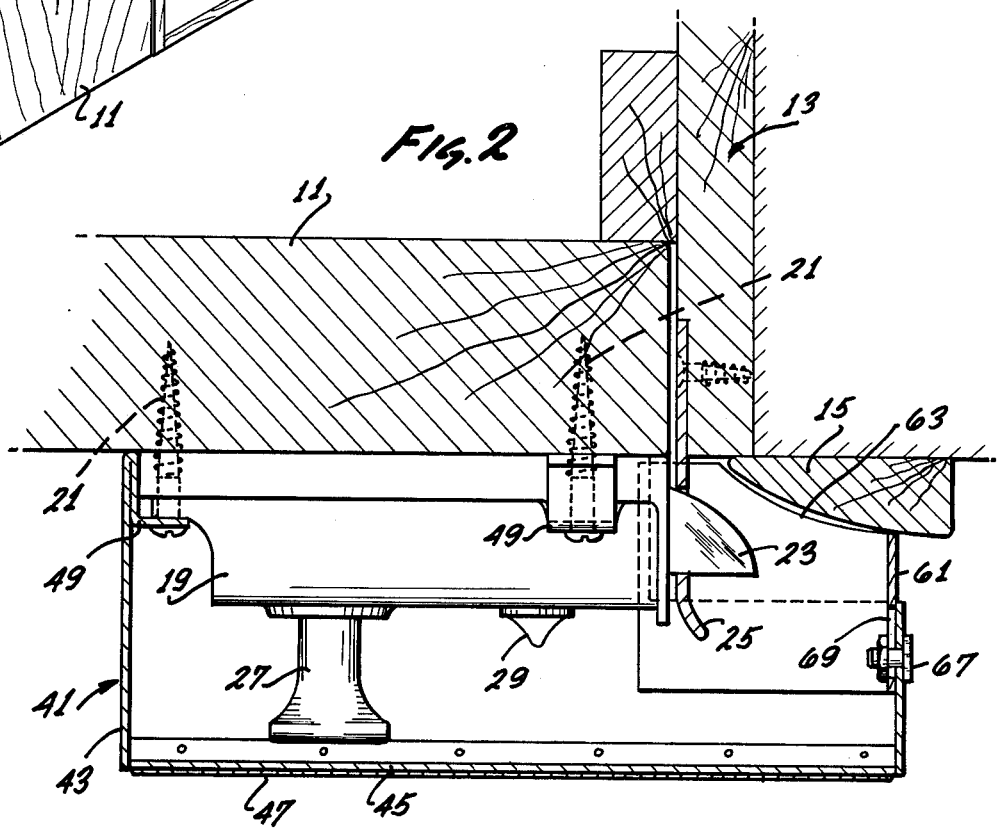
FIG. 2 comprises a partial sectional view of a device formed in accordance with the present invention as seen along the line II—II of FIG. 1.

Referring to FIGS. 1 and 2, there is illustrated a door 11 which may be closed against a jamb, generally illustrated at 13 having trim 15 thereon in a well known manner. Such a door might, for example, have a transparent or translucent panel 17 which may be manufactured from glass, plastic, or similar material, although this invention may be used with any door.

As particularly shown in FIG. 2, a manually actuable dead-bolt lock 19 may be suitably attached to the door 11 in a well known manner, such as by means of screws 21. A latch bolt 23 actuated outwardly by a spring (not shown) may cooperate with a latch strike 25, either of the type illustrated in FIG. 2, or any other well-known type. When a person on the inside of the building desires to unlock the door, he need only turn the knob 27 in the well known fashion, causing the latch bolt 23 to be withdrawn against the spring biasing force until it is pulled out of the strike 25 so that the door can be opened. If it is desired to lock the latch bolt away from its cooperation with the strike 25, a detent knob 29 may be actuated to do so in a well known manner.

In order to prevent an unauthorized intruder from breaking the panel 17 and actuating the knob 27 to unlock the door, it is proposed in accordance with the present invention to provide an enclosure, generally illustrated at 41, comprising a four-sided housing 43 which may be located about or surround the lock 19 on four sides in the manner illustrated in FIG. 2. Preferably, a cover 45 may be pivotally mounted on the housing 43 by suitable means such as a hinge 47 extending along the outer edge of the housing.

Although the housing could be mounted to the door in any suitable manner, it is presently proposed to provide a plurality of flanges 49 thereon which will cooperate with the lock 19 so that screws 21 may be passed therethrough, thus holding both the lock and the enclosure against the door. It will be realized, of course, that devices which accomplish the function of the flangs 19 may be constructed of any suitable size or shape and may either be located on the outside of the lock, as illustrated, or between the lock and the door.

Figure 4:
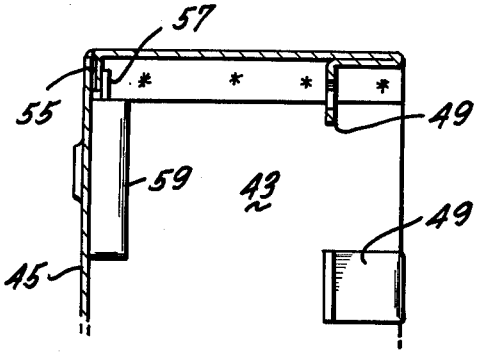
FIG. 4 comprises a partial sectional illustration of the device shown in FIGS. 1-3, taken along the line IV—IV of FIG. 3.

Preferably, a locking lip 55 may be provided on the outer edge of the housing wall opposite the hinge 47 for cooperation with a locking bar 57 of a key-actuated lock 59 in the manner illustrated in FIG. 4.

Thus, in use, a person inside the building may insert a key into the lock 59, pivot the cover 45 into a co-planar relationship with the outer edge of the housing 43, and then turn the key so that the locking bar 57 latches against the flange 55. When it is desired to unlock the door, the lock 59 may be unlocked with the key, the cover pivoted as illustrated in FIG. 3, and the knob turned in the usual manner.

Those skilled in the art will realize that a device formed in accordance with the present invention may be utilized on either the left or right edge of the door and that the cover 45 may be pivoted from either the upper edge or the lower edge of the housing, as desired. In many instances, however, it will be preferred that the hinge 47 be located along the upper edge of the housing, opposite that illustrated in FIG. 3 in order to provide additional security by inhibiting an intruder from inserting a screw driver between the cover and the wall edge to force open the lock 59.

Figure 3:
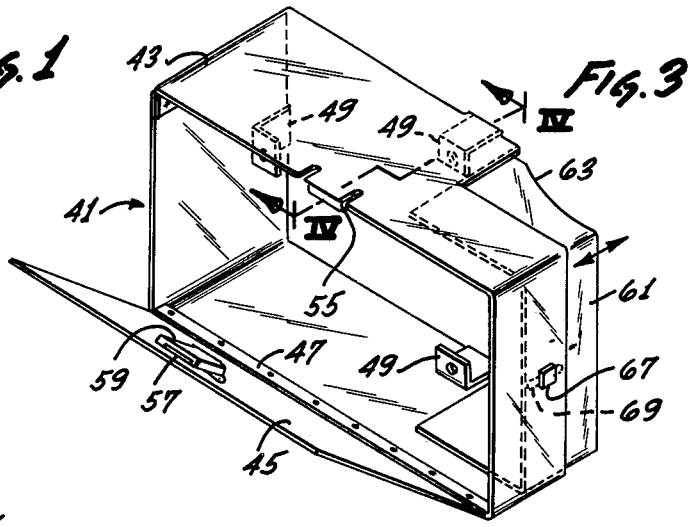
FIG. 3 comprises an isometric view of the presently preferred embodiment of the invention as depicted in FIGS. 1 and 2.

As can be particularly well seen in FIGS. 2 and 3, it is preferred that the enclosure be mounted substantially flush against the plane of the door. Often, it will be necessary that the enclosure also mount flush with the surface of the jamb trim adjacent the door, when the latter is closed. Since, in most instances, a planar irregularity exists between the door surface and the jamb trim, the present invention proposes the use, in at least some embodiments, of structure for adjusting the depth of the wall in the area of the trim.

As illustrated, a movable wall section 16 may be mounted at one end of the housing if desired. Wall section 61 may be provided with a shaped or cut away section 63 which will cooperate with the jamb trim 15. Although any suitable means may be employed, as shown in FIG. 2 a suitable fastening means 67 may pass through both the wall of the housing 43 and a slot 69 in adjustable wall section 61 as illustrated. Slot 69 allows the housing 43 and the wall section 61 to be adjusted relative to one another and suitably locked together. Thus, the end of the housing adjacent the jamb trim 15 may be substantially flush with the trim, just as the remainder of the housing is with the door, without interfering with the operation of the lock.

Of course, any suitable means, and any number of such means, may be employed to releasably fix the adjustable wall section 61 to the housing 43, so long as the enclosure is substantially flush with the wall and door portions of the building structure. Thus, the volume contained within the enclosure will be substantially totally enclosed on all sides. In other words, the housing encloses four sides of the volume, the cover 45 encloses a fifth side, and the door and/or jamb section comprises a sixth side of the volume to be protected.

As stated previously, the above description will allow those skilled in the art to quickly understand that many other embodiments of the present invention may be utilized without exceeding the scope of the invention as defined in the following claims.

I claim:

1. Apparatus for limiting access to a manually operable lock mountable on a door having a jamb upon which a striker element is mounted comprising a housing adapted to surround such a lock and its striker on all sides thereof except on the side thereof against a door comprising wall means arranged to extend substantially perpendicularly from a door and its adjacent jamb to an outer edge further from the door than the furthermost extremity of a lock and striker therefrom, cover means moveably mounted on at least one portion of said outer edge and so formed as to substantially fill the area within the boundaries formed by said outer edge when moved into position thereagainst, means for prohibiting unauthorized movement of said cover means, and means within housing for receiving the means which fasten a manufally operable lock to a door so that the lock fastening means also fix said housing to the door.

2. The device of claim 1 wherein said housing is of such size as to extend beyond the edge of a door to which it may be mounted, and said wall means includes adjustable means for positioning at least a part of that portion of said housing which extends beyond a door edge closely adjacent jamb trim on a jamb about such a door.

* * * * *